US006382758B1

(12) United States Patent
Chausanski et al.

(10) Patent No.: US 6,382,758 B1
(45) Date of Patent: May 7, 2002

(54) PRINTHEAD TEMPERATURE MONITORING SYSTEM AND METHOD UTILIZING SWITCHED, MULTIPLE SPEED INTERRUPTS

(75) Inventors: George Chausanski; Duane Edward Norris, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/583,851

(22) Filed: May 31, 2000

(51) Int. Cl.[7] ..... B41J 2/01
(52) U.S. Cl. ..... 347/17; 347/189
(58) Field of Search ..... 347/14, 17, 24, 347/189

(56) References Cited

U.S. PATENT DOCUMENTS

| | | | | |
|---|---|---|---|---|
| 4,459,469 | A | | 7/1984 | Ishima |
| 4,860,027 | A | | 8/1989 | Ozelis et al. |
| 4,860,034 | A | | 8/1989 | Watanabe et al. |
| 4,872,028 | A | | 10/1989 | Lloyd |
| 5,166,699 | A | | 11/1992 | Yano et al. |
| 5,168,284 | A | | 12/1992 | Yeung |
| 5,172,142 | A | | 12/1992 | Watanabe et al. |
| 5,331,340 | A | | 7/1994 | Sukigara |
| 5,365,257 | A | * | 11/1994 | Minowa et al. ..... 347/17 X |
| 5,367,325 | A | | 11/1994 | Yano et al. |
| 5,485,179 | A | | 1/1996 | Otsuka et al. |
| 5,519,644 | A | | 5/1996 | Benton |
| 5,559,535 | A | | 9/1996 | Otsuka et al. |
| 5,581,281 | A | | 12/1996 | Fuse |
| 5,610,638 | A | | 3/1997 | Courtney |
| 5,646,655 | A | | 7/1997 | Iwasaki |
| 5,736,995 | A | | 4/1998 | Bohorquez et al. |
| 5,745,130 | A | | 4/1998 | Becerra et al. |
| 5,751,304 | A | | 5/1998 | Hirabayashi et al. |
| 5,790,144 | A | | 8/1998 | Eade et al. |
| 5,838,341 | A | | 11/1998 | Hiwada |
| 5,881,451 | A | | 3/1999 | Kneezel et al. |
| 5,940,094 | A | | 8/1999 | Otsuka et al. |
| 5,946,007 | A | | 8/1999 | Otsuka et al. |
| 5,960,233 | A | | 9/1999 | Goto et al. |

* cited by examiner

*Primary Examiner*—Craig A Hallacher
(74) *Attorney, Agent, or Firm*—Jacqueline M. Daspit; Michael J. Nieberding

(57) ABSTRACT

A printhead temperature monitoring system includes a processor having a top priority interrupt input, a normal priority interrupt input, and at least one input for receiving temperature related signals. The processor is programmed or otherwise operable to calculate a printhead temperature based at least in part upon temperature related signals read on the input. A single timer circuit provides interrupt signals to the interrupt inputs of the processor. An interrupt control circuit is connected between the single timer circuit and the processor for selectively controlling application of timer circuit interrupt signals to the top priority interrupt of the processor and the normal priority interrupt of the processor.

25 Claims, 5 Drawing Sheets

PRINTHEAD TEMPERATURE MONITORING SYSTEM AND METHOD UTILIZING SWITCHED, MULTIPLE SPEED INTERRUPTS

TECHNICAL FIELD

The present invention relates generally to temperature control arrangements for printheads and, more particularly, to a temperature monitoring system and method which switches a timer between multiple interrupts of a processor.

BACKGROUND OF THE INVENTION

Thermal ink jet printer mechanisms which utilize printheads having heater resistors for effecting the ejection of small ink droplets from the printhead are well known. The ejection of a large number of small ink droplets at controlled locations on a printing medium produces a desired printed image. In such printheads it is desirable to control the overall temperature of the printhead in order to assure that ink droplets are delivered as desired. In order to control the printhead temperature it is of course necessary to measure or monitor the printhead temperature in some manner.

One manner of monitoring printhead temperature involves the use of one or more detectors located on the printhead. Various circuit arrangements and techniques incorporating various types of detectors can be utilized to produce temperature related signals from which the actual temperature of the printhead can be estimated or determined. One problem encountered in such arrangements is a need to read temperature related signals at specific times or intervals, even while a temperature calculation operation is taking place.

Accordingly, it would be advantageous to provide a temperature monitoring system and method which facilitates appropriate reading of temperature related signals without undue complexity or component cost.

SUMMARY OF THE INVENTION

In one aspect of the invention, a printhead temperature monitoring system includes a processor having a top priority interrupt input, a normal priority interrupt input, and at least one input for receiving temperature related signals. The processor is programmed or otherwise operable to calculate a printhead temperature based at least in part upon temperature related signals read on the input. A single timer circuit provides interrupt signals to the interrupt inputs of the processor. An interrupt control circuit is connected between the single timer circuit and the processor for selectively controlling application of timer circuit interrupt signals to the top priority interrupt of the processor and the normal priority interrupt of the processor.

In the foregoing arrangement, the interrupt control circuit may be used to deliver read triggering interrupt signals from the timer circuit to the top priority interrupt of the processor causing the processor to read a temperature related signal from the input, and to deliver temperature calculate triggering interrupt signals to the normal priority interrupt of the processor causing the processor to initiate a temperature calculation operation in a normal priority mode. During the temperature calculation operation of the processor, the processor is operable in response to a read triggering interrupt signal delivered to the top priority interrupt input to temporarily interrupt the temperature calculating operation in order to read another temperature related signal. In this manner the system assures that temperature related signals are read when necessary, but at the same time permits temperature calculating operations, which are not as time dependent as the temperature related signals themselves, to take place in a normal priority mode to reduce interference with other processor functions taking place during operation of a printer. Where a setup triggering interrupt signal is delivered to the top priority interrupt of the processor during a temperature calculating operation, the processor responsively temporarily interrupts the temperature calculating operation to perform a setup function such as clearing a counter.

In a preferred embodiment of the foregoing arrangement at least one temperature sensitive resistor is provided on a printhead and a capacitor is operatively connected to be charged through the temperature sensitive resistor. A voltage level detection circuit monitors a voltage level across the capacitor as it is charged and a counter associated with the voltage level detection circuit maintains a running count as the capacitor is charged until the voltage level across the capacitor reaches a threshold level. The count value in the counter is the temperature related signal. The top priority interrupt of the processor is an FIQ interrupt and the normal priority interrupt of the processor is an IRQ interrupt.

In another aspect of the present invention, in a printhead temperature monitoring method a step (a) involves establishing a signal which relates to a temperature of a printhead. After step (a), a step (b) involves applying an interrupt signal to a top priority interrupt of a processor which causes the processor to read the established temperature related signal. Subsequent to step (b), a step (c) involves applying an interrupt signal to a normal priority interrupt of the processor which causes the processor to initiate a temperature calculating operation. Subsequent to step (c), a step (d) involves (i) establishing a signal which relates to a temperature of a printhead, and (ii) subsequent to step (d)(i), applying an interrupt signal to a top priority interrupt of the processor which causes the processor to read the established temperature related signal of step (d)(i). During step (d)(ii) the processor temporarily interrupts the temperature calculating operation initiated in step (c) in order to read the temperature related signal of step (d)(i). Again, the subject method assures that temperature related signals are read when necessary, but at the same time permits temperature calculating operations, which are not as time dependent as the temperature related signals themselves, to take place in a normal priority mode to reduce interference with other processor functions taking place during operation of a printer.

DETAILED DESCRIPTION

Figure 1:
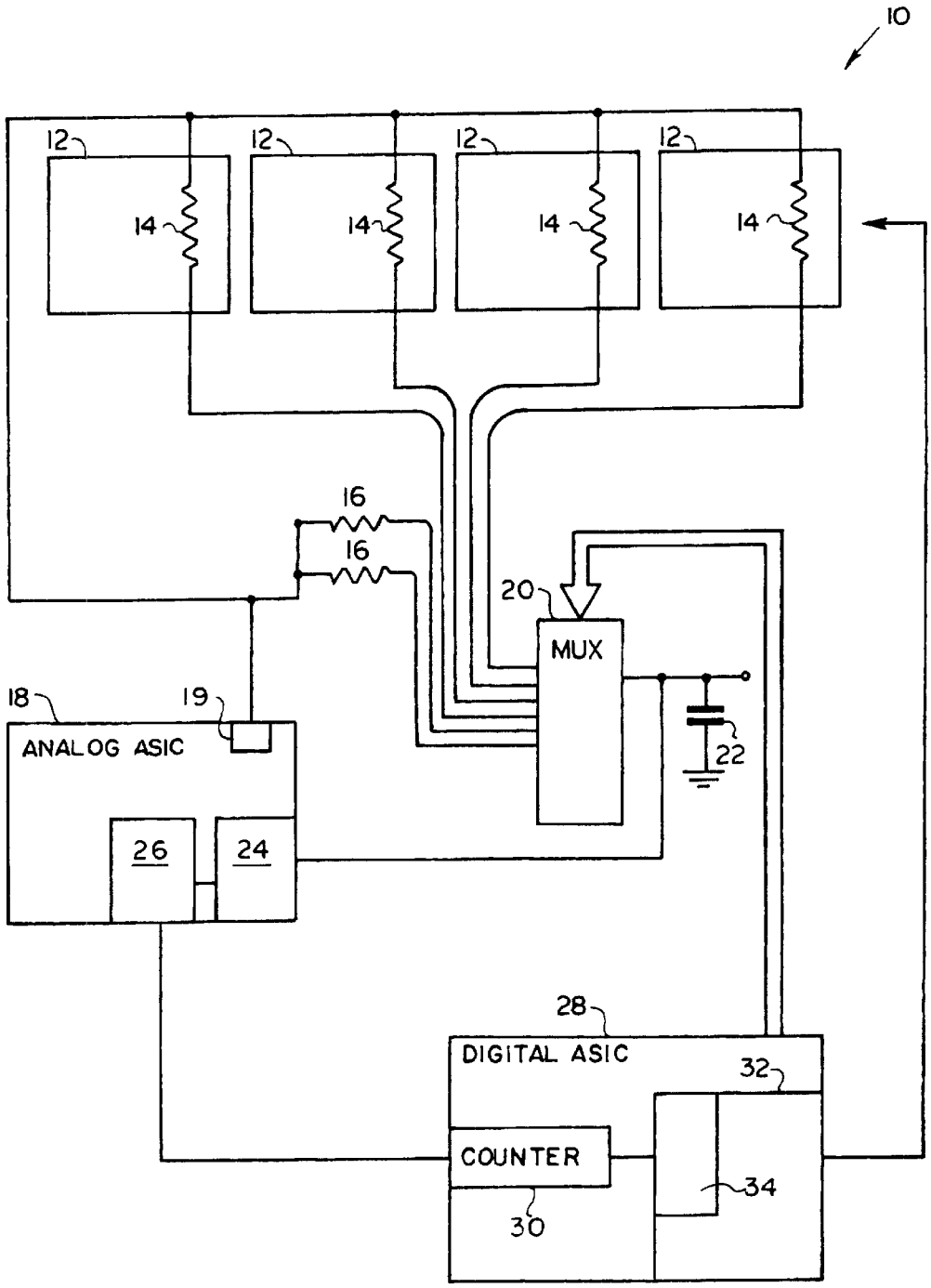
FIG. 1 is a schematic representation of a printer system according to one embodiment of the present invention.

Referring to FIG. 1, a schematic diagram of a printhead temperature control system 10 including a printhead temperature monitoring arrangement is shown. Printheads 12 include respective temperature sensitive resistors 14 (TSRs) positioned thereon. One or more calibration resistors 16 are also provided. A resistance value of TSR 14 varies as its respective printhead temperature varies. The calibration resistors 16 provide a stable known resistance value which remains substantially the same regardless of changes in temperature within the printer and are used as a control element in the system as will be described in greater detail below. The TSRs 14 and the calibration resistors 16 are connected in parallel with each other between an analog ASIC 18 and a multiplexer 20. An output of the multiplexer 20 is connected to a capacitor 22. The analog ASIC 18 provides a source of charging energy 19 which can be delivered to the capacitor 22 in a selective manner through any one of the resistors 14 and 16. Thus, by controlling the input-output path of the multiplexer 20, the charging path of the capacitor 22 can be selected to pass through any one of the resistors 14 and 16. The charge rate of the capacitor 22 will vary in accordance with the resistance of the selected charge path. Accordingly, the charge rate of the capacitor 22 can be monitored to provide an indicator of the resistance value of the selected charge path.

In this regard, the analog ASIC 18 includes a voltage level detection circuit 24 which is connected to monitor the voltage across the capacitor 22. A count or clock signal generating circuit 26 operates in conjunction with the detection circuit 24 to begin outputting a clock signal when a particular charging operation of the capacitor 22 is initiated and to cease outputting the clock signal when the voltage level across the capacitor reaches a threshold level. A digital ASIC 28 includes a counter 30 which is connected to receive the clock signal produced by circuit 26 and maintains a running count of the clock pulses produced during a charging operation of the capacitor 22. The clock signal frequency produced is constant and therefore the total count attained by the counter 30 during a charging operation is indicative of the charge rate of the capacitor 22. The count attained by the counter 30 is therefore indicative of the resistance of the selected charge path, and in the case of a TSR inclusive charge path the count attained by the counter 30 is indicative of the temperature of the printhead. While a single counter is depicted it is recognized that multiple counters may be provided, one for each selectable charge path of the capacitor 22.

Figure 2:
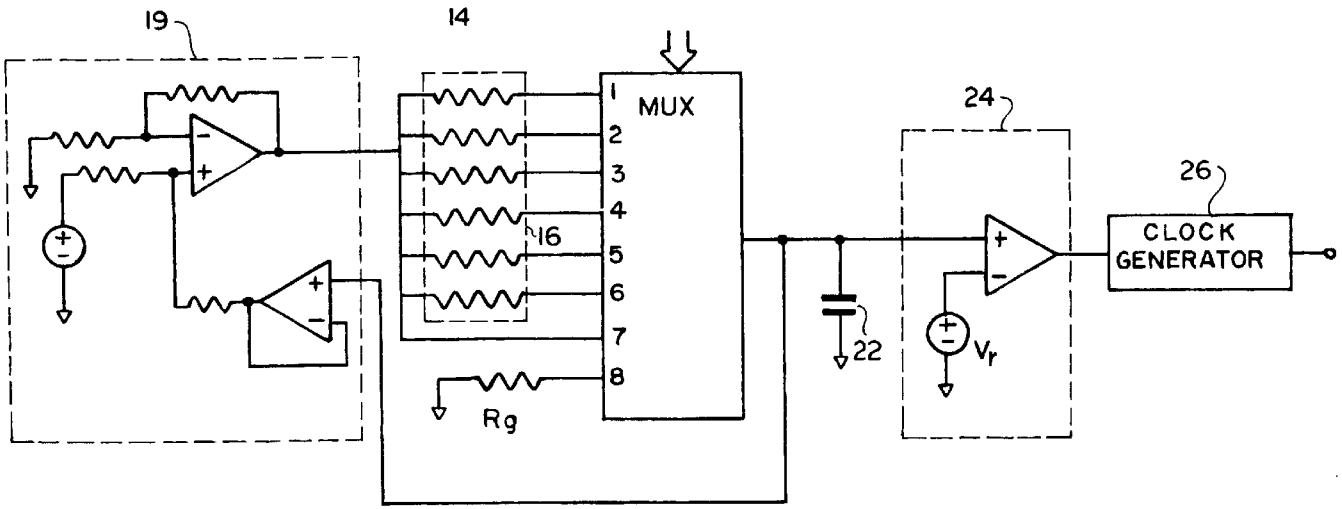
FIG. 2 is a more detailed schematic illustration of certain portions of the system of FIG. 1.

A more detailed schematic of the source of charging energy 19 and the voltage level detection circuit 24 are shown in FIG. 2. In operation, circuit 19 sets the charge voltage. Prior to each charging operation through a selected register 14 or 16, the multiplexer 20 is controlled to connect capacitor 22 through resistor Rg on channel 8 to ground in order to discharge the capacitor 22. The output of the voltage level detection circuit 24 controls the clock generator 26. In particular, when the voltage across capacitor 22 is less than reference voltage $V_R$, circuit 26 outputs a clock signal. When the voltage across capacitor 22 exceeds reference voltage $V_R$, circuit 26 stops outputting its clock signal. The output of circuit 26 is provided to the counter 30 as shown in FIG. 1. It is recognized that other voltage level detection circuits could be provided, such as a dual voltage comparator circuit which would provide a clock start output when the voltage across capacitor 22 exceeds a first reference voltage and which provides a clock stop output when the voltage across capacitor 22 exceeds a second, higher reference voltage. The charging path on channel 7 of the multiplexer can be selected to provide a count indicative of the internal resistance of the multiplexer 20.

Figure 3:
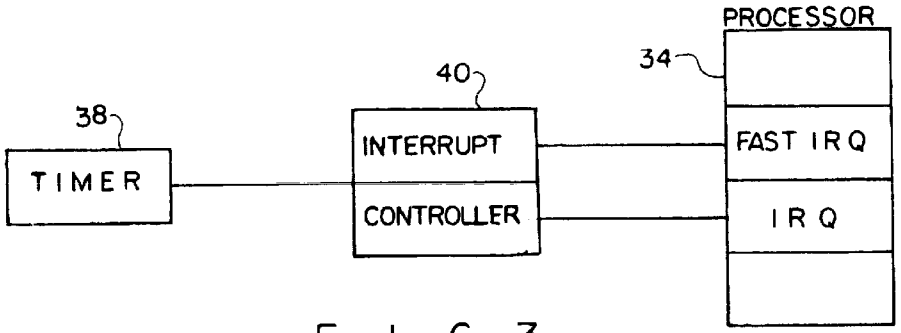
FIG. 3 is a schematic illustration of one embodiment of a timer interrupt control arrangement useful in the system of FIG. 1.

Referring again to FIG. 1, the digital ASIC 28 includes a control circuit 32 which includes a processor 34 such as a microprocessor or microcontroller and also includes a printhead driver for controlling the energization of heater resistors within the printhead 12. The heater resistors are energized to eject ink droplets and are also energized to provide temperature control of the printhead 12. The digital ASIC is also connected for controlling the multiplexer 20. Referring now to FIG. 3, an exemplary processor arrangement is depicted with processor 34 including a fast speed or top priority interrupt input ("Fast IRQ" or "FIQ") and a lesser speed or normal priority interrupt input ("IRQ"). An exemplary processor of this type is the ARM7TDMI processor which includes banked FIQ registers for storing count values. When the processor 34 receives an FIQ interrupt the processor 34 interrupts all other operations to perform a function which is initiated by the FIQ interrupt. That is, the processor 34 interrupts operations being performed in the user mode (but not the FIQ mode) of the processor and also interrupts operations being performed in the normal priority mode or IRQ mode of the processor. When the processor 34 receives an IRQ interrupt the processor 34 interrupts operations being performed in the user mode and all operations being performed in the IRQ mode are performed in a prioritized manner. A single timer 38 is provided for producing interrupt signals for the processor 34. An interrupt controller 40 is also provided for switching delivery of the timer interrupt signals between the FIQ interrupt of the processor 34 and the IRQ interrupt of the processor 34.

Figure 4:
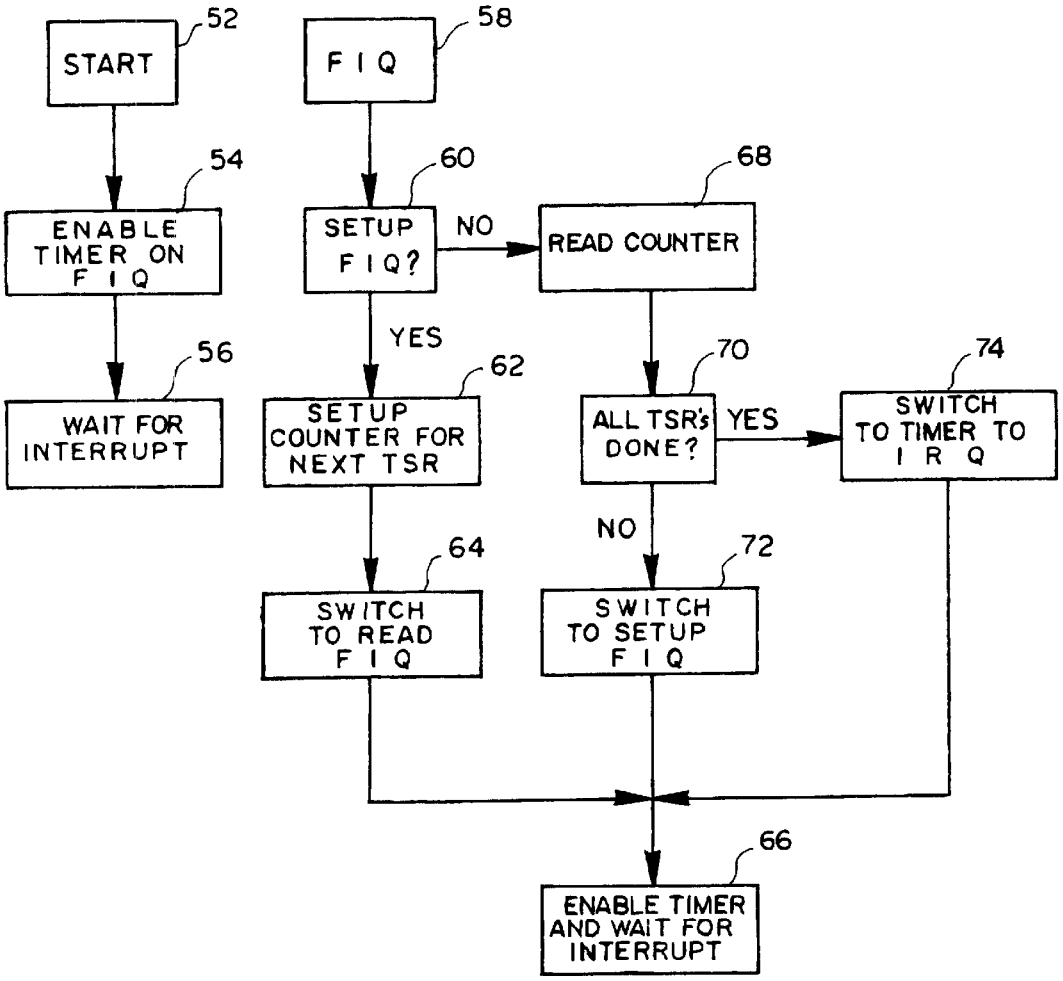
FIG. 4 is a flow chart of system operation.
Figure 5:
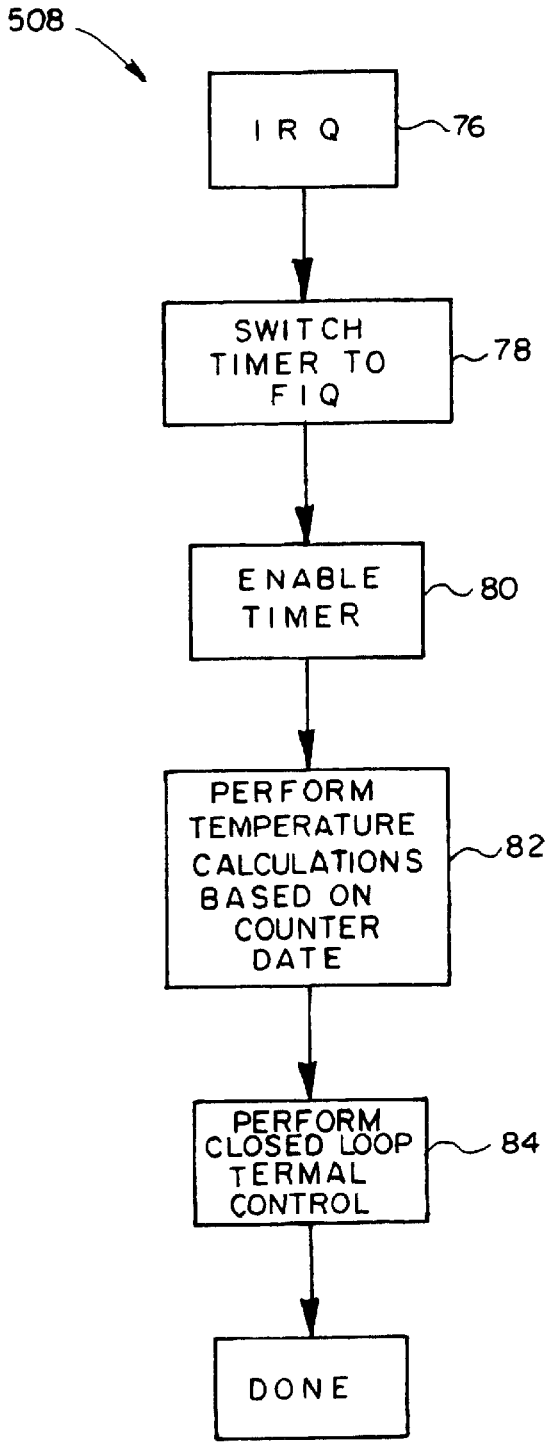
FIG. 5 is a flowchart of system operation.
Figure 6:
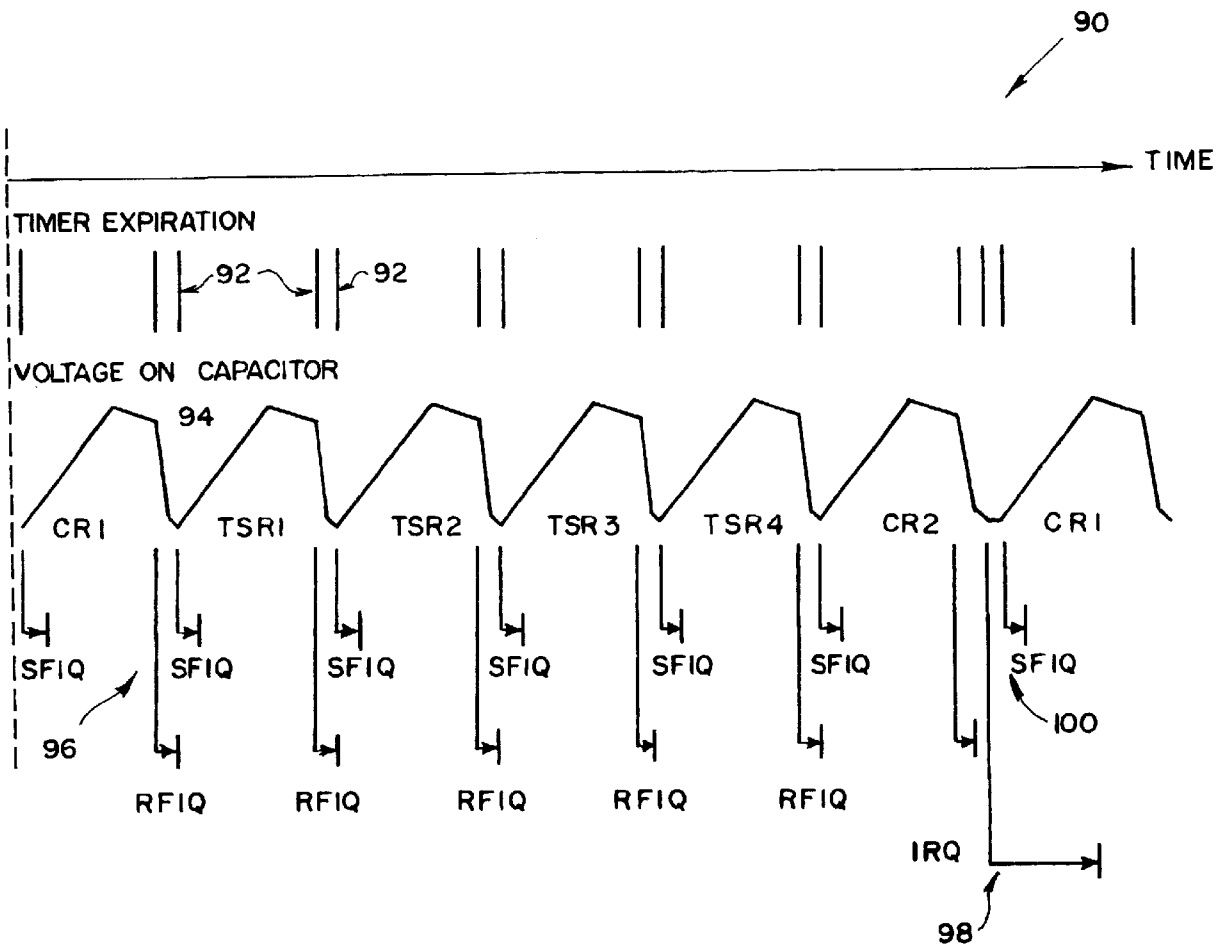
FIG. 6 is a timing diagram corresponding to the system of FIGS. 1–3 and the operations of FIGS. 4 and 5.

Exemplary operation of the system illustrated in FIGS. 1–3 is described relative to the flowcharts provided in FIGS. 4 and 5 and the timing diagram provided in FIG. 6. In particular, referring to flowchart 50A of FIG. 4, when a temperature monitoring operation starts at step 52 the timer is enabled on the FIQ. Such enablement includes configuring interrupt controller 40 to deliver signals to the FIQ interrupt, configuring the processor 34 to be responsive to an FIQ interrupt and starting the timer 38. A wait for interrupt step 56 is also shown.

When an interrupt signal is received at the FIQ interrupt of the processor 34 as indicated at step 58, a determination is made at step 60 as to whether the processor is awaiting a "Setup FIQ" interrupt. The particular FIQ interrupt mode of the processor 34 is stored as a bit in memory accessible by the processor 34, and at step 60 the processor reads that stored bit. If the processor is awaiting a "Setup FIQ" interrupt then the YES path is followed and at step 62 the counter 30 is cleared to prepare for the next charging operation. At step 64 the stored FIQ mode bit is flipped to indicate that the processor is now awaiting a Read FIQ interrupt and at step 66 the timer is enabled to provide the next interrupt signal at a specific time. Simultaneously, a charging operation of the capacitor 22 is initiated through a selected resistor. When the timer 38 outputs the next FIQ interrupt at step 58, the NO path from step 60 will be followed due to the bit flip which took place in step 64, and at step 68 the count value attained by the counter 30 is read. At step 70 a determination is made as to whether all charge paths have been selected. If not, the NO path is followed and at step 72 the FIQ mode bit is flipped to indicate that the processor 34 is awaiting a "Setup FIQ" interrupt and the timer is again enabled at step 66. This sequence of steps is followed until a determination is made at step 70 that all necessary charge paths have been selected, meaning the temperature calculation operation can be initiated.

Once the system is ready for a temperature calculation operation the YES path from step 70 is followed and the interrupt controller 40 is reconfigured to deliver interrupt signals to the IRQ interrupt of the processor 34. The timer is enabled at step 66 to produce the next interrupt signal. The next interrupt signal is an IRQ interrupt as depicted in flowchart 50B at step 76. The interrupt controller 40 is then reconfigured at step 78 to deliver subsequent interrupt signals to the FIQ interrupt and the timer is enabled at step 80 so that the next counter value can be read at the appropriate time. Steps 78 and 80 are important in that the processor 34 is configured to permit counter values to be read per an FIQ interrupt even as the processor 34 performs a temperature calculation in the IRQ mode. Step 82 identifies the calculation of temperature operation and step 84 indicates a closed loop temperature control operation performed to adjust the temperature of the printheads 12.

Referring to FIG. 6, an exemplary timing diagram 90 of system steps is provided showing expiration times 92 of the timer 38, voltage level 94 of the capacitor 22, and durations of the FIQ and IRQ operations initiated by the interrupt signals as indicated at lower portion 96. The charging operation for the calibration resistors are identified as CR1 and CR2 in the capacitor voltage portion 94 of the diagram 90. Four TSRs 14 are provided and the chargin operation for each is identified as TSR1, TSR2, TSR3 and TSR4 in the diagram. The occurrence and duration of the Setup FIQs (SFIQ) and the Read FIQs (RFIQ) is shown in portion 96. After a charging operation has been performed for both of the calibration resistors CR1 and CR2 and each of the TSRs 14, the IRQ interrupt occurs at 98 to initiate the temperature calculating operation of the processor 34. Notably, the IRQ operation overlaps the next Setup FIQ interrupt 100. At the next Setup FIQ interrupt 100, the processor 34 temporarily interrupts the IRQ mode temperature calculation in order to perform one or more setup functions such as clearing the counter 30 and delivering a control signal to the multiplexer 20 in order to select the next desired charge path. Likewise, the IRQ operation could also overlap with a next Read FIQ interrupt which will cause the processor 34 to momentarily interrupt the IRQ mode temperature calculation in order to read another count value from the counter 30.

Thus, the system permits excellent timing control of charge path selection and charge operation initiation and also enables temperature related signals to be read quickly by the processor 34 at specific times and at fast speeds which avoid interference with other process or operations. As used herein, the terminology "temperature related signal" is intended to encompass any signal read by the processor 34 and used by the processor 34 in calculating temperature. The terminology "temperature calculation" and "temperature calculating operation" is intended to include all calculations performed based upon one or more temperature related signals, including calculations to determine the resistences of the TSRs, as the resistance determination may merely be a first step towards calculating the final temperature.

Although the invention has been described above in detail referencing the preferred embodiments thereof, it is recognized that various changes and modifications could be made without departing from the spirit and scope of the invention.

What is claimed is:

1. A printhead temperature monitoring system, comprising:

at least first and second printheads;

at least first and second temperature sensitive resistors, each associated with a respective printhead;

a capacitor with each of said temperature sensitive resistors selectively connectable in line with said capacitor for delivering charging energy to said capacitor;

a voltage level detection circuit for monitoring a voltage level across said capacitor as it is charged;

a counter associated with said voltage level detection circuit to maintain a running count as said capacitor is charged until said voltage level across said capacitor reaches a threshold level;

a processor connected for reading a count value of said counter and operable to determine a printhead temperature based at least in part upon said count value;

a timer circuit for providing signals to interrupt inputs of said processor; and an interrupt control circuit connected between said timer circuit and said processor for selectively controlling application of said timer circuit signals to an FIQ interrupt of said processor and an IRQ interrupt of said processor.

2. The system of claim 1 wherein said interrupt control circuit delivers counter read triggering signals from said timer circuit to said FIQ interrupt of said processor, and wherein said interrupt control circuit delivers temperature calculate triggering signals from said timer circuit to said IRQ interrupt of said processor.

3. The system of claim 2 wherein said FIQ interrupt of said processor is enabled while said processor performs temperature calculations.

4. The system of claim 1, further comprising:

a source of energy operatively connected to said temperature sensitive resistors for charging said capacitor through said resistors.

5. The system of claim 4, further comprising:

at least one calibration resistor selectively connectable in line with said capacitor.

6. A printhead temperature monitoring system, comprising:

a charging capacitor;

a voltage level detection circuit for monitoring a voltage level across said capacitor as it is charged;

a charge timing circuit associated with said voltage level detection circuit for producing a charge time indicative signal corresponding to a time taken for said charging capacitor voltage level to reach a threshold level as it is being charged;

a processor connected to said charge timing circuit for reading the charge time indicative signal therefrom, said processor operable to calculate a printhead temperature based at least in part upon said charge time indicative signal;

a single timer circuit for providing interrupt signals to interrupt inputs of said processor;

an interrupt control circuit connected between said single timer circuit and said processor for selectively controlling application of said timer circuit interrupt signals to a top priority interrupt of said processor and a normal priority interrupt of said processor, said top priority interrupt causing said processor to momentarily interrupt functions being performed in a normal priority interrupt mode of said processor.

7. The system of claim 6 wherein said charge timing circuit includes a counter for maintaining a running count as said charging capacitor is charged, and said charge time indicative signal is a count value of said counter.

8. The system of claim 6 wherein said top priority interrupt comprises an FIQ interrupt and said normal priority interrupt comprises an IRQ interrupt.

9. The system of claim 6 wherein said interrupt control circuit delivers setup triggering interrupt signals and charge time read triggering interrupt signals from said timer circuit to said top priority interrupt of said processor, and wherein said interrupt control circuit delivers temperature calculate triggering interrupt signals to said normal priority interrupt of said processor.

10. The system of claim 9 wherein said top priority interrupt of said processor is enabled while said processor performs temperature calculations in said normal priority interrupt mode.

11. The system of claim 6, further comprising:

a plurality of temperature sensitive resistors each located on a respective printhead, each temperature sensitive resistor selectively connectable in line with said charging capacitor to affect a charge rate of said charging capacitor.

12. The system of claim 11, further comprising:

at least one calibration resistor selectively connectable in line with said charging capacitor to affect a charge rate of said charging capacitor.

13. The system of claim 12 wherein said calibration resistor and said plurality of temperature sensitive resistors are connected in parallel between a source of charging energy and said charging capacitor, and wherein the system includes a multiplexing circuit connected between said resistors and said charging capacitor for selectively controlling a charge path of said charging capacitor.

14. A method of determining a temperature of a printhead, comprising the steps of:

(a) applying charging energy to a charging capacitor through a resistor;

(b) monitoring a time period taken for said charging capacitor to reach a threshold voltage level;

(c) applying an interrupt signal from a timer circuit to a top priority interrupt of a processor, causing the processor to read a signal indicative of the time period monitored in step (b);

(d) subsequent to steps (a) through (c), applying an interrupt signal from the timer circuit to a normal priority interrupt of the processor, causing the processor to begin a temperature calculating operation which is based at least in part upon the signal read by the processor in step (c);

(e) subsequent to step (d), applying an interrupt signal from the timer circuit to the top priority interrupt of the processor, causing the processor to temporarily interrupt its temperature calculating operation.

15. The method of claim 14, comprising the further step of:

(f) subsequent to step (d):

(i) applying charging energy to the charging capacitor through the resistor located on the printhead; and (ii) monitoring a time period taken for the charging capacitor to reach the threshold voltage level;

wherein in step (e) the interrupt signal causes the processor to read a signal indicative of the time period monitored in step (f)(ii).

16. The method of claim 14 wherein in step (e) the interrupt signal comprises a setup triggering interrupt signal which causes the processor to clear a counter which stores the signal indicative of the time period monitored in step (b).

17. The method of claim 14 wherein steps (a), (b) and (c) are performed for a plurality of resistors prior to performing step (d), a multiplicity of said resistors comprising temperature sensitive resistors each of which is located on a respective printhead.

18. The method of claim 14 wherein the top priority interrupt comprises an FIQ interrupt of the processor and the normal priority interrupt comprises an IRQ interrupt of the processor.

19. A method comprising the steps of:

(a) establishing a signal which relates to a temperature of a printhead;

(b) subsequent to step (a), applying an interrupt signal to a top priority interrupt of a processor which causes the processor to read the established temperature related signal of step (a);

(c) subsequent to step (b), applying an interrupt signal to a normal priority interrupt of said processor which causes said processor to initiate a temperature calculating operation;

(d) subsequent to step (c):

(i) establishing a signal which relates to a temperature of a printhead; and (ii) subsequent to step (d)(i), applying an interrupt signal to the top priority interrupt of the processor which causes the processor to read the established temperature related signal of step (d)(i), wherein during step (d)(ii) the processor temporarily interrupts the temperature calculating operation initiated in step (c) in order to read the temperature related signal of step (d)(i).

20. The method of claim 19 wherein, prior to step (c), steps (a) and (b) are repeated until the processor has read a desired set of temperature related signals.

21. The method of claim 19 wherein the interrupt signals of steps (b), (c), and (d)(ii) are generated by a single timer which is selectively applied to the top priority interrupt in steps (b) and (d)(ii) and to the normal priority interrupt in step (c).

22. The method of claim 19 wherein step (a) involves charging a capacitor and monitoring a time period for the capacitor to reach a threshold voltage level when being charged.

23. A printhead temperature monitoring system, comprising:

a processor having a top priority interrupt input, a normal priority interrupt input, and at least one input for receiving temperature related signals, said processor operable to calculate a printhead temperature based at least in part upon temperature related signals read on said at least one input;

a single timer circuit for providing interrupt signals to said interrupt inputs of said processor; and an interrupt control circuit connected between said single timer circuit and said processor for selectively controlling application of said timer circuit interrupt signals to said top priority interrupt of said processor and said normal priority interrupt of said processor.

24. The system of claim 23 wherein said interrupt control circuit delivers setup triggering interrupt signals from said timer circuit to said top priority interrupt of said processor, wherein said interrupt control circuit delivers temperature calculate triggering interrupt signals to said normal priority interrupt of said processor causing said processor to initiate a temperature calculation operation in a normal priority mode, and wherein, during said temperature calculation operation of said processor, said processor is operable in response to a setup triggering interrupt signal delivered to said top priority interrupt input to temporarily interrupt said temperature calculating operation in order to clear a counter.

25. The system of claim 23 wherein said interrupt control circuit delivers read triggering interrupt signals from said timer circuit to said top priority interrupt of said processor causing said processor to read a temperature related signal on said at least one input, wherein said interrupt control circuit delivers temperature calculate triggering interrupt signals to said normal priority interrupt of said processor causing said processor to initiate a temperature calculation operation in a normal priority mode, and wherein, during said temperature calculation operation of said processor, said processor is operable in response to a read triggering interrupt signal delivered to said top priority interrupt input to temporarily interrupt said temperature calculating operation in order to read another temperature related signal.

* * * * *